United States Patent [19]

Cooper

[11] Patent Number: 5,002,186

[45] Date of Patent: Mar. 26, 1991

[54] ARTICLE CARRIER WITH CUSHIONED PANEL

[75] Inventor: Leonard M. Cooper, West Monroe, La.

[73] Assignee: Manville Corporation, Denver, Colo.

[21] Appl. No.: 509,922

[22] Filed: Apr. 16, 1990

[51] Int. Cl.[5] ..... B65D 65/00

[52] U.S. Cl. ..... 206/433; 206/193; 206/427; 229/40

[58] Field of Search ..... 206/193, 427, 433, 446, 206/140, 148, 586, 591, 592, 594; 229/40

[56] References Cited

U.S. PATENT DOCUMENTS

| | | | |
|---|---|---|---|
| 1,850,714 | 3/1932 | Gaylord | 206/433 |
| 2,129,488 | 9/1938 | Bomberger | 206/433 |
| 2,314,198 | 3/1943 | Roamer | 206/433 |
| 2,744,624 | 5/1956 | Hoogstoel et al. | 206/433 |
| 3,093,068 | 6/1978 | Smit | 206/433 |
| 3,351,264 | 11/1967 | Bostrom | 206/433 |
| 4,095,693 | 6/1978 | Killy | 206/433 |
| 4,735,315 | 4/1988 | Oliff et al. | 206/427 |
| 4,773,540 | 9/1988 | Schuster | 206/427 |

FOREIGN PATENT DOCUMENTS

| | | | |
|---|---|---|---|
| 1552219 | 9/1979 | United Kingdom | 206/433 |

*Primary Examiner*—David T. Fidei
*Attorney, Agent, or Firm*—John D. Lister

[57] ABSTRACT

A paperboard carrier for beverage cans the bottom of which tend to be deformed when subjected to sharp blows. The panel adjacent the can bottoms is formed of two sheets in face-to-face engagement. The interior face of the inner sheet contains a number of raised embossed portions against which the can bottoms abut. The embossed portions, which may be comprised of spaced embossed protrusions of circular or other shape, effectively increase the cushioning effect of the sheet and, in conjunction with the other sheet of the panel, protect the can bottom against damage. The embossed portions are arranged so as to contact the circumferential rims normally provided at the bottom of beverage cans.

6 Claims, 2 Drawing Sheets

ARTICLE CARRIER WITH CUSHIONED PANEL

FIELD OF THE INVENTION

This invention relates to article carriers. More particularly, it relates to paperboard carriers which can be used to package beverage containers.

BACKGROUND OF THE INVENTION

Paperboard cartons or carriers are used to package a variety of different types of articles, including beverage containers. When used to package beverage cans some carriers are designed to receive the cans so that the ends of the cans are adjacent the side panels of the carrier while others are designed so that the cans are positioned with their tops adjacent the top panel and their bottoms adjacent the bottom panel. In either arrangement the cans are normally tightly held in place inside the carrier, with the ends of the cans engaging the adjacent panels. A common example is a carrier designed to hold twelve cans, with the can ends contacting the side panels of the carrier so tightly that the impressions of the can ends can be seen in the outer surface of the side panels.

It is of course necessary to tightly package the cans in order to prevent them from breaking free of the carrier during handling. It will be appreciated that in the course of shipping and unloading the carriers, they may be subjected to impact loads caused by being dropped or roughly piled on top of one another. Because the carriers are designed to withstand this type of treatment they normally do not fail as a result. Sharp blows on the can ends through the carrier panels can, however, produce an adverse effect on the cans themselves.

The beverage cans packaged in paperboard carriers typically are aluminum cans formed with a generally flat top recessed from a relatively narrow top rim. The rim is quite rigid and capable of receiving hard blows on its edge without deforming. The bottoms are typically of concave shape recessed from a somewhat wider bottom rim which does not have the edge strength of the top rim. The bottom rim instead is more of an integral contour of the can bottom and, as such, can more readily be deformed or driven up into the body of the can.

When such a carrier is dropped or harshly stacked the bottom rims of the cans adjacent the carrier panel receiving the blow are in danger of being flattened in the area of the impact or pushed up into the interior of the can. When the bottom rim is pushed up into the can the resulting reduction in can volume causes the liquid inside the can to exert sufficient additional pressure on the bottom to bow the bottom out from its original concave configuration to a convex shape, thereby relieving the pressure. This action is known as "doming". While the doming phenomenon allows the can to retain its liquid without splitting or otherwise failing, when a consumer uses the can the curved dome-shaped bottom cannot hold the can in steady condition on a table or other support surface. Even if the impact to the bottom rim is not enough to cause severe doming, the rim will often be flattened where the impact occurred to the extent that the can is unsteady when placed upright on a support surface.

It would be highly desirable to be able to package beverage cans in a manner which prevents damage to the can bottoms but does not require costly new packages or major modification to packaging machines currently in use.

BRIEF SUMMARY OF THE INVENTION

In accordance with the invention a panel of a paperboard carrier in contact with an end of an article is comprised of an inner sheet and an outer sheet in face-to-face engagement. The interior face of the inner sheet contains a plurality of spaced raised embossed portions of such size and in such numbers that adjacent ends of the articles in the carrier contact or abut the raised portions. Preferably, the inner sheet is connected along a fold line to an edge of a first panel extending at substantially right angles to the inner sheet, and the outer sheet is connected along a fold line to an edge of a second panel extending at substantially right angles to the outer sheet, the first and second panels comprising opposite panels of the carrier.

In a carrier containing beverage cans, the circumferential bottom rim of each can contacts a number of the embossed portions. Because the embossed sheet acts as a shock absorber, the cushioning effect provided by this arrangement in combination with the extra sheet in the panel contacting the bottom ends of the cans protects against deformation of the cans of the type described above. In a preferred arrangement the greatest dimension of the raised embossed portions is substantially less than the width of the adjacent end of a can, and adjacent embossed portions are spaced apart a distance less than their greatest dimension.

The panel can readily be incorporated in a carrier by modifying the blank normally used to form the carrier to include an extra section incorporating the embossed portions.

The above and other aspects of the invention, as well as other benefits thereof, will readily be apparent from the more detailed description of the preferred embodiment which follows.

DETAILED DESCRIPTION OF THE PREFERRED EMBODIMENT

Figure 1:
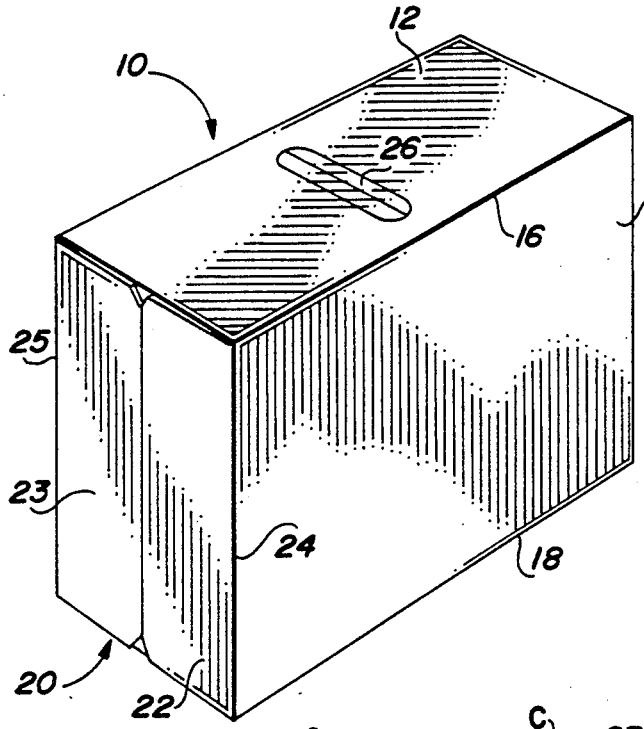
FIG. 1 is a pictorial view of a beverage can carrier incorporating a panel formed according to the present invention.

Referring to FIG. 1, a carrier 10 incorporating the invention comprises a top panel 12 connected to the nearest side panel 14 along fold line 16. A bottom panel, not visible in this view, is connected to the side panel 14 by fold line 18, and end panels 20 are formed from end panel flaps 22, which are connected to the side panel 14 along fold lines 24, and end panel flaps 23, which are connected to the opposite side panel along fold lines 25. A handle 26 is provided in the top panel 12 for lifting the carrier. The carrier illustrated is the type fabricated from a blank which has been formed from an open-ended carrier sleeve, wherein the articles to be packaged are introduced to the sleeve through the open ends, after which the end panels are formed from the end flaps. The carrier is adapted to hold a number of beverage cans the ends of which are adjacent the side panels of the carrier.

Figure 2:
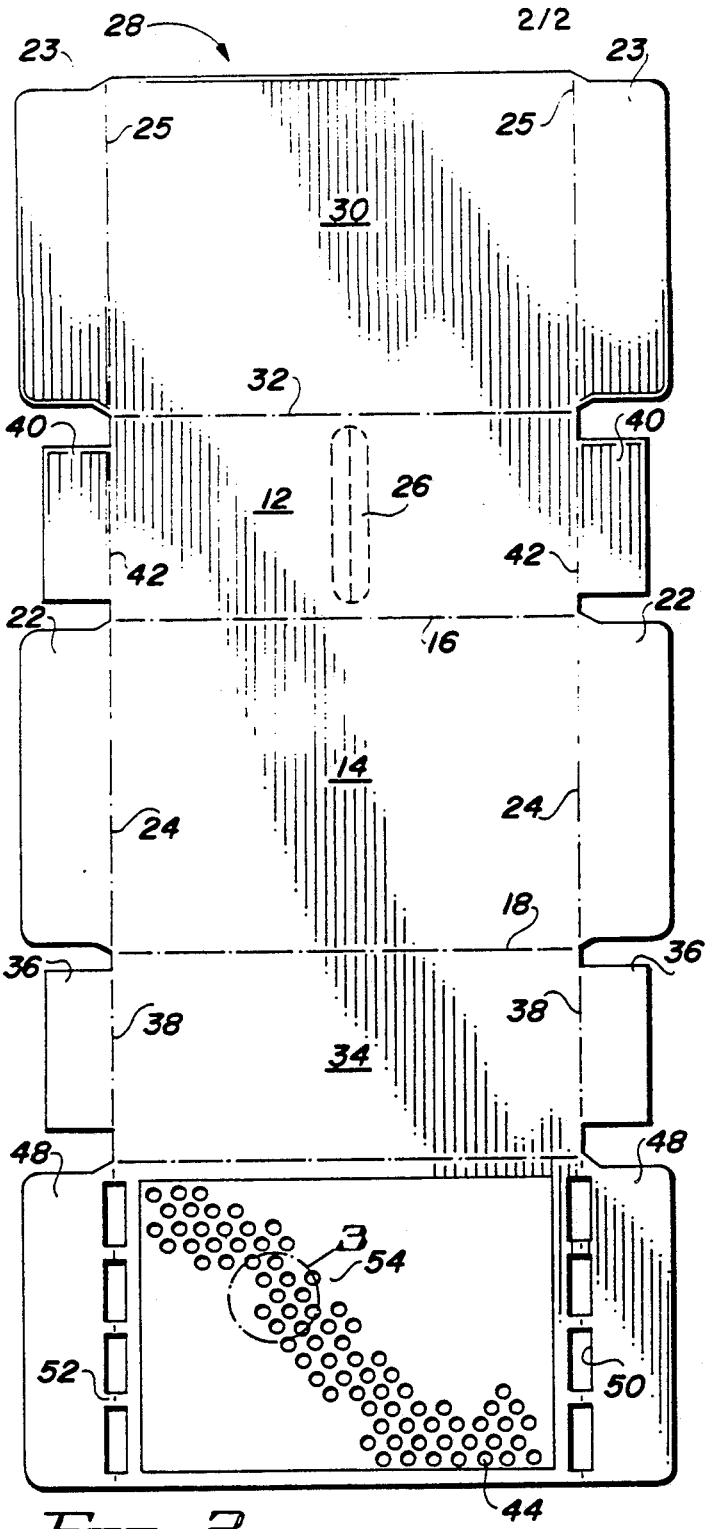
FIG. 2 is a plan view of a production blank from which the carrier of FIG. 1 may be formed.

Referring to FIG. 2, wherein like reference numerals as in FIG. 1 refer to like elements, the interior surface of a blank 28 for forming a carrier 10 is illustrated. The blank 28 includes a side panel section 30, corresponding to the far side panel in the carrier of FIG. 1, which is connected to top panel section 12 along score line 32. The side panel section 30 is connected to end panel flaps 23 along score lines 25 in the same manner as the end panel flaps 22 are connected to the side panel section 14. A bottom panel section 34 is connected to the side panel section 14 along score line 18 and is further connected to dust flaps 36 along score lines 38. Dust flaps 40 are connected to top panel 12 in a similar manner along score lines 42.

An additional side panel section 44 is connected to the bottom panel section 34 along score line 46, and is also connected to end panel flaps 48 along fold lines comprised of aligned cutouts 50 spaced from each other by narrow strips 52. The strips 52 may also contain a slit for ease of folding. The inner face of the section 44 contains a number of spaced raised embossed portions 54 shown in more detail in FIGS. 3 and 4, which are discussed further hereinafter.

Figure 5:
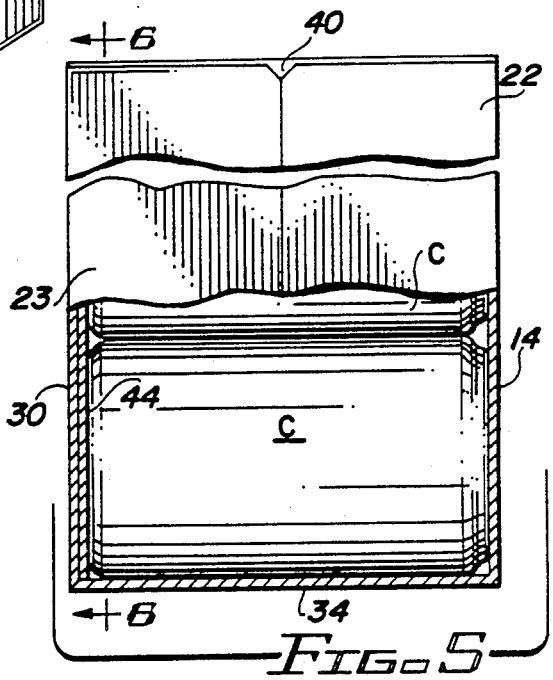
FIG. 5 is an end view of the carrier of FIG. 1 with portions thereof removed.

In forming a carrier from the blank of FIG. 2, the blank is folded along score lines 32, 16, 18 and 46 so that the side panel section 44, extending up from the bottom panel section 34, is in face-to-face relationship with side panel section 30, and is adhered to the side panel section 30 by suitable adhesive. It will be understood that the end flaps 48 of side panel section 44 are also adhered to the end flaps 22 of the side panel section 30. The resulting sleeve is introduced to a packaging machine in collapsed form and is subsequently opened to rectilinear form in order to receive articles introduced through the open ends of the sleeve. After the articles are in place the dust flaps 36 and 40 are folded about their fold lines 38 and 42, and the end panel flaps 22 and the combined end panel flaps 23 and 48 are folded and glued to the dust flaps, as is well known in the industry. The cutouts 50 and narrow strips 52 connecting the end flaps 48 to the side panel section 44 allow the combined end flaps to be readily folded in the final forming steps of the loaded carrier despite the double thickness of paperboard, which otherwise would tend to impede the folding process. As can be seen in FIG. 5, the ends of cans C which have been loaded into the sleeve are shown abutting the side panel 14 and the inner side panel sheet 44 after the end panels have been formed. Note the double thickness of the side panel formed by the sheets or panel sections 30 and 44.

Figure 3:
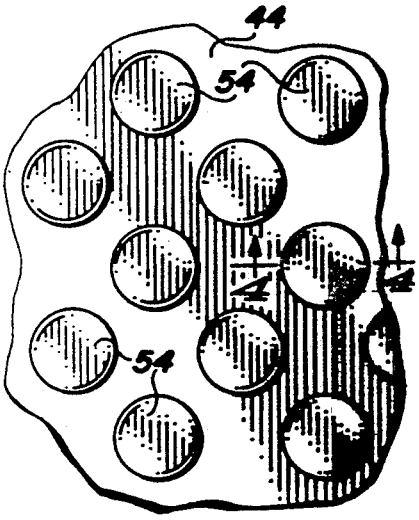
FIG. 3 is a partial plan view of the portion of the blank of FIG. 2 enclosed in the circle 3.
Figure 4:
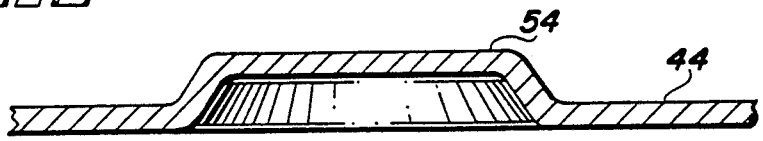
FIG. 4 is an enlarged transverse sectional view taken on line 4—4 of FIG. 3.

The embossed portions illustrated in FIG. 3 are circular in shape in plan view and are arranged in rows whereby the embossments in one row are staggered with respect to the embossments in adjacent rows and whereby the embossments are spaced from the embossments in adjacent rows by a distance less than the diameter of the circles. As an example, the diameter of the circular raised embossed portions in one design of the invention is $\frac{3}{8}$ inch, with the raised portions in each row being spaced apart $\frac{3}{8}$ inch and being spaced from the raised portions in adjacent rows $\frac{1}{8}$ inch. The raised portions 54 extend above the base of the panel section 44 only a short distance which is, however, significant with respect to the thickness of the paperboard sheet comprising the panel section. Although the embossments are shown for purposes of illustration in FIGS. 4, 7 and 8 as extending a substantial distance above the plane of the panel section 44, it will be understood that the illustration is somewhat exaggerated in order to more vividly show the design principles involved. In fact, as an example, the raised embossed portion of a sheet having a thickness of 0.018 inch may extend above the sheet a distance of about 0.002 inch to 0.010 inch, with the other side of the embossed portion being recessed from the other side of the sheet by a similar amount. This correlates to an embossed height above the base sheet of approximately 10% to 55% of the thickness of the base sheet.

Figure 7:
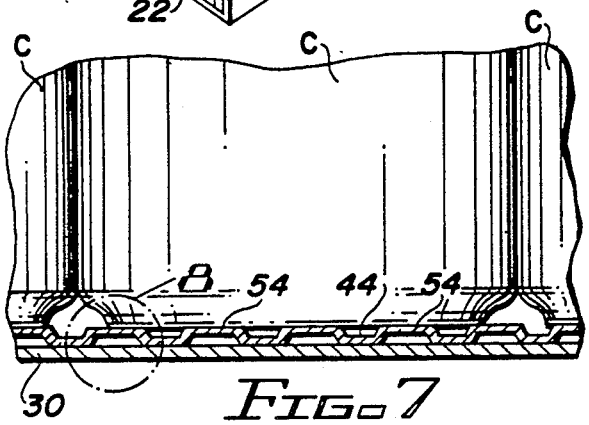
FIG. 7 is an enlarged partial transverse sectional view of the cushioned panel of the invention, showing the panel in conjunction with adjacent can bottoms in a carrier.
Figure 6:
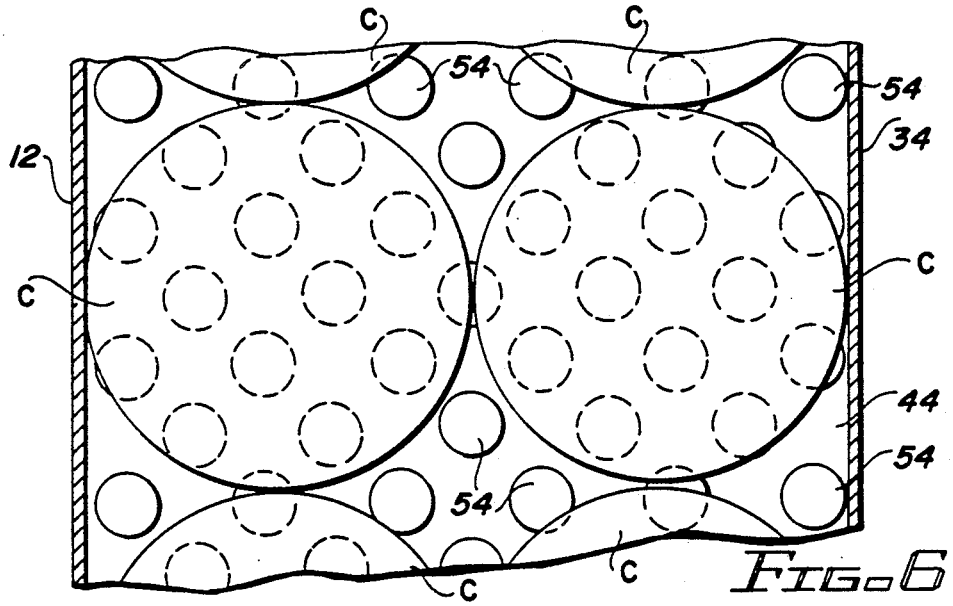
FIG. 6 is a partial sectional view taken on line 6—6 of FIG. 5, showing the embossments hidden by the cans in dotted lines.
Figure 8:
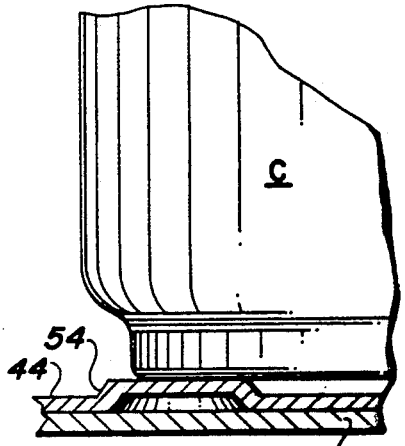
FIG. 8 is a further enlarged view of the portion of FIG. 7 enclosed in the circle 8.

Although the invention is not limited to the specific size and shape of the dimples or embossments illustrated, or to the pattern or design by which they are laid out, they should be arranged so that the circumferential rims of beverage can bottoms contact the raised portions at enough points to keep the rims spaced from the surface of the base sheet, as illustrated in FIGS. 6 and 7. With such an arrangement a typical sharp blow to the side panel adjacent the can bottoms which normally would be capable of deforming the bottom rim or causing doming of the bottom, will be absorbed by the double thickness of paperboard to prevent the cans from being damaged. It is noted that it is not merely the double thickness of paperboard that provides this function, but the double thickness in combination with the embossed configuration of the inner side panel sheet. When the side panel is subjected to impact loads, the embossed portions 54 act somewhat as springs, with the fibers of the paperboard which connect the embossed portions to the base of the sheet biasing the embossed portions out of the plane of the sheet against the force of the load. This in effect increases the functional thickness of the sheet to maximize its cushioning effect on the can bottoms. Therefore, the embossed portions should be arranged not only to provide support for substantial portions of the bottom rim of a can, but to ensure that the embossed portions are sufficiently biased so as to function in the manner of a spring. Thus the embossed portions should not be so small that the connecting fibers do not provide sufficient bias, nor should they be so large that the central portions of the embossments fail to provide sufficient bias due to being spaced too far from the connecting fibers. In a preferred embodiment, the narrowest distance between opposite portions of the embossments is not less than about 3/16 inch or more than about $\frac{1}{2}$ inch. In the embodiment illustrated, where the embossments are dimpled so as to be circular in shape, this dimensional range refers to the diameter of the circular embossment.

It will be understood that while the invention has been described particularly in connection with the packaging of beverage cans which are subject to damage from impact loading, the features of the invention may also be used to cushion impact loading on other types of articles packaged in a carton or carrier.

In summary, the present invention provides a simple modification to paperboard carriers which does not require basic changes to the packaging machine, and yet is able to provide the desired protection to the carrier contents.

It should now be apparent that the invention is not necessarily limited to all the specific details described in connection with the preferred embodiment, but that changes to certain features of the preferred embodiment which do not alter the overall basic function and concept of the invention may be made without departing from the spirit and scope of the invention, as defined in the appended claims.

What is claimed is:

1. An article carrier containing a plurality of beverage cans the bottom ends of which include a circumferential rim extending below the portion of the can bottom enclosed by the rim, the carrier being substantially rectilinear in transverse cross-section and comprising:

a panel contacted by the circumferential rims of the cans;

said panel being comprised of a plurality of sheets of paperboard in face-to-face engagement, including an inner sheet and an outer sheet;

the inner sheet of said panel being connected along a fold line to an edge of a first panel extending at substantially right angles to said inner sheet, and the outer sheet being connected along a fold line to an edge of a second panel extending at substantially right angles to said outer sheet, the first and second panels comprising opposite panels of the carrier and said fold lines being parallel;

the inner sheet having an interior face comprised of a planar portion and a plurality of spaced raised embossed portions extending from the planar portion and projecting into the interior of the carrier, the embossed portions being of such size and being present in such numbers that the adjacent circumferential rims of the cans abut a sufficient number of said raised embossed portions so as to maintain the rims out of contact with the planar portion of the inner sheet; and the greatest dimension of the raised embossed portions being substantially less than the diameter of the circumferential rim of an adjacent can.

2. The article carrier of claim 1, wherein the inner and outer sheets together comprise a side panel of the carrier.

3. The article carrier of claim 1, wherein the minimum distance between the raised embossed portions is less than the greatest dimension thereof.

4. The article carrier of claim 1, wherein the narrowest dimension of the embossed portions in plan view is not less than about 3/16 inch or more than about ½ inch.

5. The article carrier of claim 4, wherein the raised portions are of substantially the same size and shape and are circular in plan view.

6. The article carrier of claim 1, wherein the embossed portions extend beyond the interior face of the inner sheet an amount in the approximate range of 10% to 55% of the thickness of the inner sheet.

* * * * *